US005233394A

United States Patent [19]

Fujita et al.

[11] Patent Number: 5,233,394

[45] Date of Patent: Aug. 3, 1993

[54] TRANSFER DEVICE FOR USE IN AN IMAGE FORMING APPARATUS

[75] Inventors: Shigeo Fujita, Moriguchi; Ryuji Wataki, Nara, both of Japan

[73] Assignee: Mita Industrial Co., Ltd., Osaka, Japan

[21] Appl. No.: 889,014

[22] Filed: May 26, 1992

[30] Foreign Application Priority Data

May 29, 1991 [JP] Japan ..... 3-125818
May 29, 1991 [JP] Japan ..... 3-125819

[51] Int. Cl.[5] ..... G03G 15/14

[52] U.S. Cl. ..... 355/271; 355/273; 355/277

[58] Field of Search ..... 355/271, 273–277, 355/280, 281, 208, 219

[56] References Cited

U.S. PATENT DOCUMENTS

| | | | |
|---|---|---|---|
| 3,751,156 | 8/1973 | Szostak et al. | 355/273 |
| 4,081,212 | 3/1978 | Wetzer | 355/274 |
| 4,110,031 | 8/1979 | Ebi et al. | 355/274 |
| 4,183,655 | 1/1980 | Umahashi et al. | 355/274 |
| 4,457,615 | 7/1984 | Seaner | 355/219 |
| 4,998,143 | 3/1991 | Kumasaka et al. | 355/271 |
| 5,101,238 | 3/1992 | Creveling et al. | 355/271 |
| 5,159,390 | 10/1992 | Imaizumi | 355/271 X |
| 5,172,173 | 12/1992 | Goto et al. | 355/275 |
| 5,173,735 | 12/1992 | Kusumoto | 355/271 |

*Primary Examiner*—A. T. Grimley
*Assistant Examiner*—Matthew S. Smith
*Attorney, Agent, or Firm*—Jordan and Hamburg

[57] ABSTRACT

A transfer device for use in an image forming apparatus provided with a photosensitive drum on which a toner image is formed, the transfer device including a transfer member which is charged to transfer the toner image formed on the photosensitive drum to a copy sheet, a cleaner for cleaning toner depositing on the transfer member, and a power supply unit for applying a voltage to the cleaner to charge the transfer member, the cleaner being constructed so as to produce a potential difference between the cleaner and transfer member to attract the toner depositing on the transfer member. Accordingly, the transfer device of the invention is allowed to have a more simplified construction compared to existing transfer devices.

8 Claims, 8 Drawing Sheets

TRANSFER DEVICE FOR USE IN AN IMAGE FORMING APPARATUS

BACKGROUND OF THE INVENTION AND RELATED ART STATEMENT

This invention relates to a transfer device for use in an image forming apparatus for transferring a toner image to a copy sheet.

There have been generally known a transfer device provided with a transfer roller and another transfer device provided with a transfer belt. In the former transfer device, voltage is applied to the transfer roller upon start of an image transfer operation, and thereby a toner image formed on the surface of a photosensitive drum is transferred to a copy sheet while the copy sheet is passing through a nip between the transfer roller and drum. Further in the latter transfer device, the transfer belt is charged by a transfer charger. The charged transfer belt electrostatically attracts a copy sheet and transports the same to a photosensitive drum, and thereby a toner image formed on the photosensitive drum is transferred to the copy sheet while the copy sheet is passing through a contact portion of the transfer belt and drum.

The transfer device is provided with a brush member for removing or cleaning toner depositing on the surface of the transfer roller or belt. Upon completion of the image. transfer operation, voltage is applied to the brush member and the toner depositing on the transfer roller or belt is electrically attracted to the brush member. Thereby, the surface of the transfer roller or belt is cleaned.

However, the transfer device is provided with a power supply unit for applying power to the transfer roller or belt and another power supply unit for applying power to the brush member. Provision of two power supplies has been an obstacle to higher cost effectiveness and has required larger space.

SUMMARY OF THE INVENTION

In view of the above drawbacks, it is an object of the present invention to provide a transfer device for use in an image forming apparatus which is allowed to have a more simplified construction by reducing the number of power supplies provided therein.

Accordingly, the invention is directed to a transfer device for use in an image forming apparatus provided with image bearing means on which a toner image is formed, the transfer device comprising transfer means which is charged to transfer the toner image formed on the image bearing means to a copy sheet, cleaner means for cleaning toner depositing on the transfer means, and power supply means for applying a voltage to the cleaner means to charge the transfer means, the cleaner means being constructed so as to produce a potential difference between the cleaner means and transfer means to attract the toner depositing in the transfer means.

With the transfer device thus constructed, the voltage is applied only to the cleaner means and the transfer means is charged by way of the cleaner means to transfer the toner image to the copy sheet. Further, the toner depositing (residual) on the transfer means is attracted to the cleaner means due to the potential difference produced between the cleaner means and transfer means, and thereby the transfer means is cleaned. It is sufficient to provide a power source for applying the voltage to the cleaner means and accordingly another power supply unit for applying the voltage directly to the transfer means can be dispensed with. Therefore, the transfer device can be simplified in construction and takes up less space.

The cleaner means may be a brush member made of conductive material. The brush member is capable of attracting the toner depositing on the transfer means effectively as well as brushing the toner off the transfer means on account of the shape thereof. Accordingly, the transfer means can be cleaned more reliably. Also, the cleaner means may be spaced away from the transfer means by a specified distance so as not to damage or spoil the surface of the transfer means.

Further, the cleaner means may be supplied with a second voltage, which is used to clean the transfer means and lower than a first voltage required to charge the transfer means to have a potential at which the toner image is transferable to the copy sheet, while an image transfer operation is not carried out. This will contribute to reduction in overall power consumption.

The power supply means may include a power source e for outputting an alternate voltage, transformer means having a first transformer unit for transforming the alternate voltage from the alternate current power source into a first alternate voltage and a second transformer unit for transforming the alternate voltage into a second alternate voltage, switch means for switchingly outputting the first voltage from the first outlet tap and the second voltage from the second outlet tap, conversion means for converting the first and second alternate voltages from the switch means respectively into first and second direct voltages and applying the same to the cleaner means, detector means for detecting an image transfer period during which the toner image on the image bearing means is transferred to the copy sheet, and switch control means for causing the switch means to output the first voltage at least during the image transfer period. With this arrangement, the first voltage is applied to the cleaner means from the first outlet tap at least during the image transfer period while the second voltage is applied thereto from the second outlet tap otherwise. Accordingly, power will be consumed effectively and reliably.

These and other objects, features and advantages of the present invention will become more apparent upon a reading of the following detailed description and accompanying drawings.

DETAILED DESCRIPTION OF THE PREFERRED EMBODIMENTS OF THE INVENTION

Figure 2:
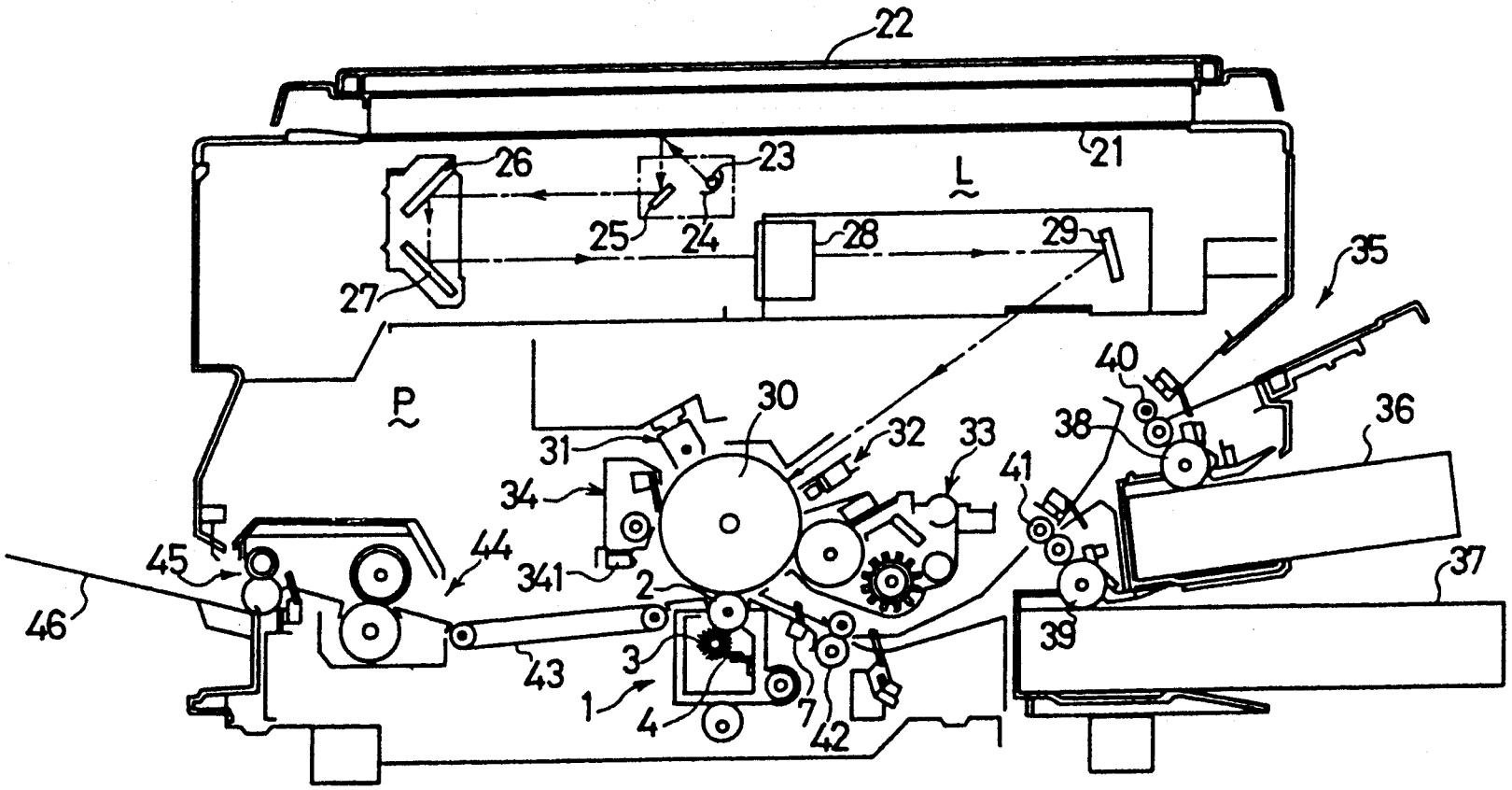
FIG. 2 is a schematic diagram showing a construction of an image forming apparatus incorporating the first transfer device.

FIG. 2 is a schematic diagram showing a construction of an image forming apparatus incorporating a first transfer device in accordance with the invention.

The image forming apparatus is provided with a document platen 21 and document holder 22 at a top thereof and with an optical system L and imaging assembly P in an interior thereof.

The optical system L includes a light source having a halogen lamp 23 and reflector 24, reflector mirrors 25, 26, and 27, lens array 28, and fixed mirror 29. Upon start of a copying operation, light from the light source is reflected by a document placed on the document platen 21, and introduced to the lens array 28 by way of reflector mirrors 25 to 27. Then, the light is projected onto the surface of a photosensitive drum 30 by way of the fixed mirror 29.

The imaging assembly P includes the photosensitive drum 30, main charger 31, blank lamp 32, developing device 33, transfer device 1, cleaning device 34, charge releasing lamp 341, etc. After charged by the main charger 31 while rotating, the drum 30 is exposed to the reflected light and thereby an electrostatic latent image is formed thereon.

The electrostatic latent image is developed by the developing device 33 into a toner image. The toner image is transferred to a copy sheet, which is in turn separated from the surface of the drum 30. On the other hand, there are arranged a sheet insertion inlet 35, cassettes 36 and 37, feed rollers 38 and 39, a pair of transport rollers 41, and a pair of registration rollers 42 from an upstream side with respect to a direction of transport of the copy sheet (hereinafter referred to as a sheet transport direction). These are arranged to feed the copy sheet to the drum 30. Further, the charge releasing lamp 341 is lighted to release charges from the surface of the drum 30, and then the toner residual on the drum 30 after the image transfer operation is cleaned by the cleaning device 34.

There are arranged a transport belt 43, fixing device 44, a pair of discharge rollers 45, etc. downstream of the drum 30 with respect to the sheet transport direction. The copy sheet having the document image transferred thereto is transported by the transport belt 43 to the fixing device 44 in which the document image is fixed to the copy sheet. Consequently, the copy sheet is discharged onto a discharge tray by way of the discharge roller pair 45.

Now, there will be described a detailed construction of the first transfer device 1.

The transfer device 1 is provided with a transfer roller 2, brush member 3, cleaning blade 4, and the like. The transfer roller 2, whose circumferential portion made of sponge, polyurethane rubber or like elastic material, is disposed in pressing contact with the photosensitive drum 30. The transfer roller 2 is charged by way of the brush member 3 as will be described later and is rotated together with the drum 30. The copy sheet has the toner image formed on the drum 30 transferred thereto while passing through a nip between the transfer roller 2 and drum 30. The brush member 3 includes a shaft and numerous hair-like strands made of conductive material having a specified resistance value such as conductive rayon. The numerous stands of the brush member 3 are attached to the shaft thereof. The brush member 3 is in contact with the transfer roller 2, and charges the roller 2 with a direct voltage supplied from an ac-to-dc converter 9 thereto. Since the brush member 3 is made of conductive material having the specified resistance value, a substantial potential difference is produced between a center portion of the brush member 3 and the surface of the transfer roller 2. In addition, since tips of strands of the brush member 3 are in contact with the transfer roller 2, the potential difference is increased due to the point-to-surface contact resistance. The toner on the surface of the transfer roller 2 is electrically attracted to the brush member 3 due to the above potential difference and also brushed off by the brush member 3. Accordingly, the transfer roller 2 can be effectively cleaned. It will be understood that the cleaning blade 4 is arranged to clean the brush member 3 by dusting off the toner attached to the member 3.

Next, there will be described an electric system for charging the transfer roller 2 with reference to FIG. 1.

A transformer 6 is supplied with an alternate voltage from an alternate current power source PS and transforms the supplied ac voltage into a high ac voltage used to charge the transfer roller 2 to have a potential necessary to transfer the toner image to the copy sheet and a low ac voltage used to clean the transfer roller 2. The transformer 6 includes first and second outlet taps **6*a* and 6*b* through which the high and low ac voltages are outputted. A switch unit 5 selectively outputs to the converter 9 either one of the high ac voltage and low ac voltage respectively from the first and second outlet taps 6*a* and 6*b* of the transformer 6 in accordance with a switch signal from a control unit 8. The converter 9 converts the high or low ac voltage from the switch unit 5 into a high or low dc voltage and applies the converted voltage to the shaft of the brush member 3. From the first outlet tap 6*a* is supplied a high ac voltage of, for example, 2.5 KV. On the other hand, from the second outlet tap 6*b*** is supplied a low ac voltage of, for example, 300 V.

Upon application of the high dc voltage from the converter 9 to the brush member 3, the transfer roller 2 is charged by way of the brush member 3. Thereafter, when the low dc voltage from the converter 9 is applied to the brush member 3, the charges of the transfer roller 2 are released by way of the brush member 3 and the toner residual on the roller 2 is attracted to the brush member 3 due to a potential difference between the brush member 3 and roller 2. In this way, the transfer roller 2 is cleaned.

Figure 1:
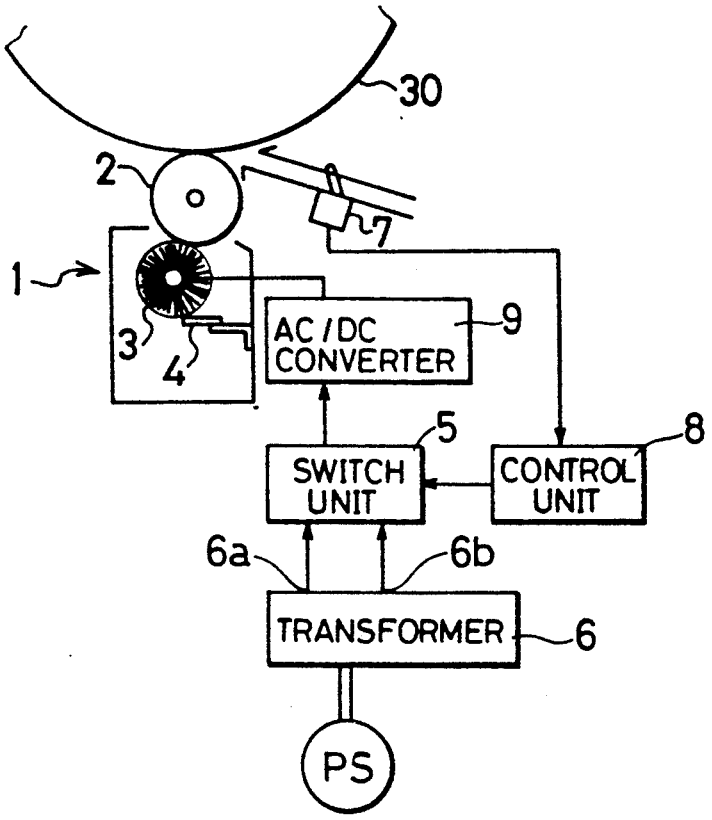
FIG. 1 is a schematic diagram showing a construction of a first transfer device in accordance with the invention.

A sheet sensor switch 7 is disposed along a sheet transport path upstream of the transfer device 1 as shown in FIGS. 1 and 2. The sensor switch 7 is turned off upon detecting a leading edge of the copy sheet while turning on upon detecting a trailing edge thereof.

The control unit 8 determines whether the image transfer operation is being carried out in accordance with a sensor signal from the sensor switch 7, and causes the switch unit 5 to output the high ac voltage to be converted and applied to the brush member 3 during the image transfer operation by sending a switch signal to the switch unit 5. Also, the control unit 8 causes the switch unit 5 to output the low ac voltage to be converted and applied to the brush member 3 after the image transfer operation by sending the switch signal to the switch unit 5. The control unit 8 is, for example, provided internally with a timer for measuring a predetermined period corresponding to a time required for the leading edge of the copy sheet to be transported from the sensor switch 7 to the nip between the transfer roller 2 and photosensitive drum 30. Upon lapse of the predetermined period following the fall of the sensor signal from the sensor switch 7, the control unit 8 determines that the leading edge of the copy sheet has reached the nip between the roller 2 and drum 3, i.e. the image transfer operation is started. On the other hand, upon lapse of the predetermined period following the rise of the sensor signal from the sensor switch 7, the control unit 8 determines that the image transfer operation has been completed.

Figure 3:
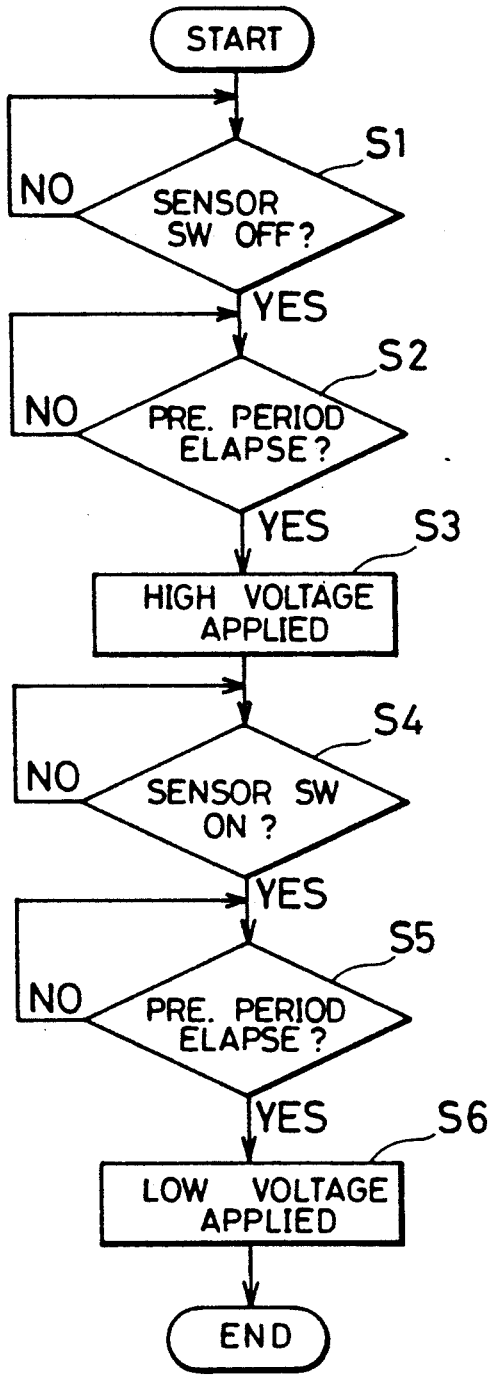
FIG. 3 is a flow chart showing operations of the first transfer device.

Next, there will be described operations of the first transfer device 1 with reference to a flow chart shown in FIG. 3.

When feeding of the copy sheet is started upon start of the copying operation, it is discriminated whether the sheet sensor switch 7 is in the OFF state in Step S1. This routine waits in standby in Step S1 until the sensor switch 7 is turned off (NO in Step S1).

If the leading edge of the copy sheet has been transported up to the sensor switch 7 to turn it off (YES in Step S1), it is discriminated whether the predetermined period has elapsed following turning-off of the sensor switch 7 in Step S2. This routine waits in standby in Step S2 while the timer is measuring the predetermined time (NO in Step S2). Upon lapse of the predetermined period (YES in Step S2), the high ac voltage from the first outlet tap 6*a* is converted into the high dc voltage by the converter 9 and applied to the brush member 3 in Step S3. In this way, the transfer roller 2 is charged by way of the brush member 3 and the toner image formed on the photosensitive drum 30 is transferred to the fed copy sheet due to the potential difference between the roller 2 and drum 30.

Subsequently, it is discriminated whether the sensor switch 7 is in the ON state in Step S4. This routine waits in standby in Step S4 until the sensor switch 7 is turned on (NO in Step S4).

On the other hand, when the sensor switch 7 is turned on upon detecting the trailing edge of the copy sheet (YES in Step S4), it is discriminated whether the predetermined period has elapsed following turning-on of the sensor switch 7 in Step S5. This routine waits in standby in Step S5 while the timer is measuring the predetermined period (NO in Step S5). Upon lapse of the predetermined period (YES in Step S5), the low ac voltage from the second outlet tap 6*b* of the power supply unit 6 is converted into a low dc voltage by the converter 9 and applied to the brush member 3 in Step S6. In this way, the charges of the transfer roller 2 are released by way of the brush member 3 and the toner residual on the roller 2 are attracted to the brush member 3 due to the potential difference between the brush member 3 and roller 2, and thereby the roller 2 is cleaned.

Since the transfer roller 2 is charged by way of the brush member 3 during the image transfer operation, there can be obviated the need for a power source and a transformer exclusively for use in charging the roller 2. Also, the low dc voltage is applied to the brush member 3 after the image transfer operation, and the toner residual on the roller 2 is removed therefrom.

Figure 5:
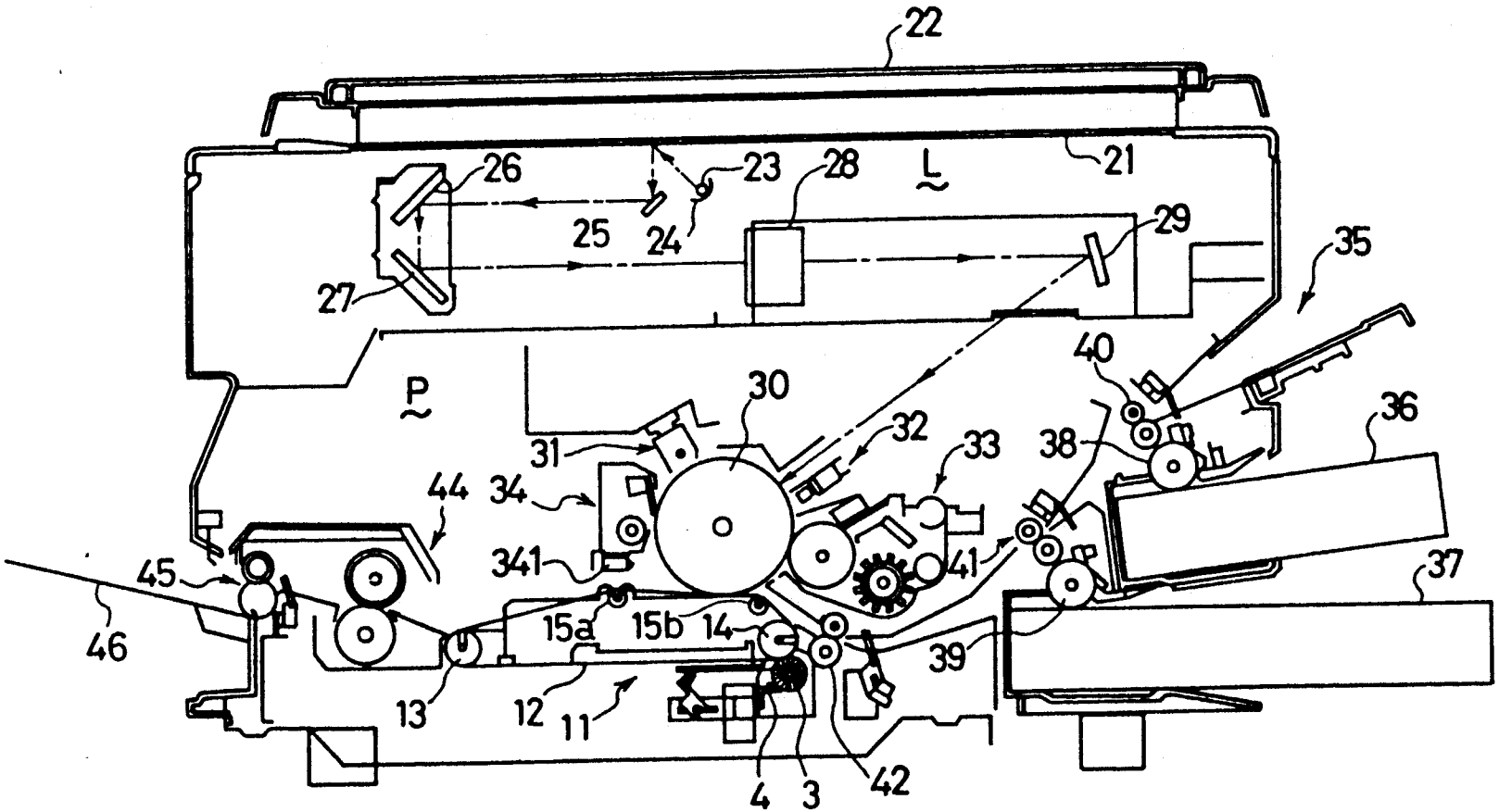
FIG. 5 is a schematic diagram showing a construction of an image forming apparatus incorporating the second transfer device.

FIG. 5 is a schematic diagram showing an image forming apparatus incorporating a second transfer device 11 in accordance with the invention. It will be appreciated that like numerals designate like parts in FIGS. 2 and 5.

In place of the transfer roller 2, sheet sensor switch 7 and transport belt 43 of the first transfer device 1, the second transfer device 11 is provided with a transfer belt 12 serving as a transfer member and a transport belt, drive roller 13, driven roller 14, intermediate rollers 15*a*, 15*b*, etc.

The transfer belt 12 is made of polyurethane rubber or like material and stretched by the rollers 13, 14, 15*a* and 15*b*. The transfer belt 12 electrostatically attracts a copy sheet downstream of a photosensitive drum 30, transfer a toner image formed on the drum 30 to the copy sheet, and transports the copy sheet to a fixing device 44. The transfer belt 12 is charged by way of a brush member 3 with a high dc voltage from an ac-to-dc converter 9. The drive roller 13 is disposed upstream of and in proximity to the fixing device 44 and drivingly rotated by an unillustrated drive motor or the like to drive the transfer belt 12. The driven roller 14 is disposed downstream of and in proximity to a pair of registration rollers 42. The intermediate rollers 15*a*, 15*b* are disposed in such positions that a portion of the transfer belt 12 stretched therebetween is in pressing contact with the photosensitive drum 30. The drive roller 13 and intermediate roller 15*a* are grounded so as to release the charges of the transfer belt 12.

Figure 4:
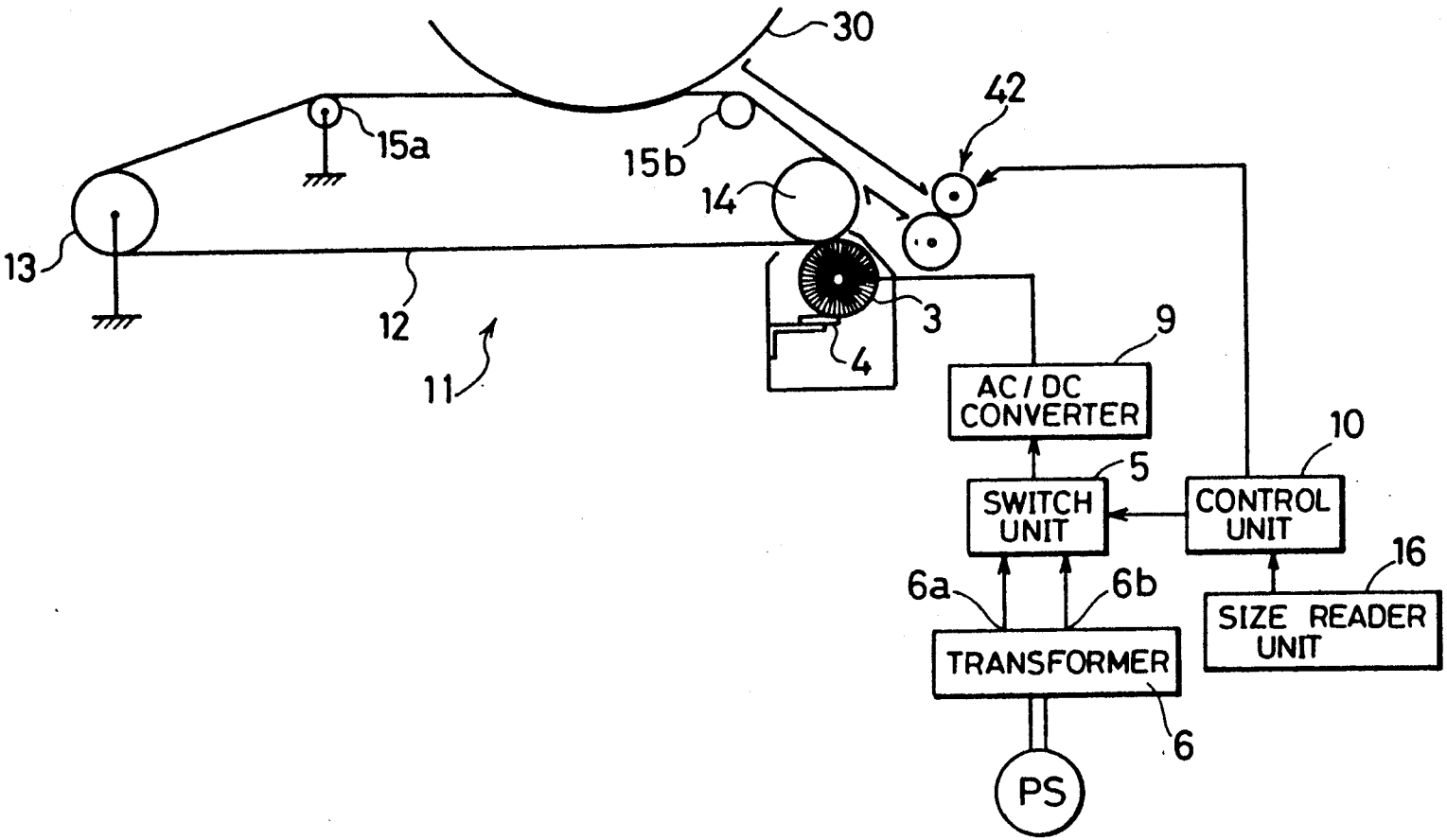
FIG. 4 is a schematic diagram showing a construction of a second transfer device in accordance with the invention.

Next, there will be described an electric system for charging the transfer belt 12 with reference to FIG. 4. It will be appreciated that like numerals designate like parts in FIGS. 1 and 4.

A control unit 10 causes the drive roller 13 to rotate to drive the transfer belt 12 and sends a switch signal to a switch unit 5 so as to charge the transfer belt 12 with a high dc voltage, when a copying operation is started in response to manipulation of an unillustrated operation key. Upon receipt of the switch signal, the switch unit 5 outputs the high ac voltage to the converter 9 and consequently the high dc voltage is applied to the brush member 3. Further, the control unit 10 controls the driving of the registration roller pair 42 so that the copy sheet is placed on a region of the transfer belt 12 charged with the high dc voltage, thereby also controlling a transport timing of the copy sheet. Moreover, the control unit 8 is, for example, provided internally with a timer for measuring a predetermined period required for the transfer belt 12 to be charged with the high dc voltage at least by a distance corresponding to the length of the copy sheet following start of application of the high dc voltage to the brush member 3. Hereinafter, such a predetermined period is referred to as a charging period. Upon lapse of the charging period, the control unit 10 causes the switch unit 5 to output a low ac voltage to be converted and applied to the brush member 3 by sending the switch signal thereto. A size reader unit 16 discriminates the size and posture of the copy sheet based on the setting by the operation key or based on marks provided on cassette 36, 37 which indicates the size of copy sheets contained in these cassettes. The size and posture of the copy sheet is used to detect the length of the copy sheet with respect to the sheet transport direction.

Figure 6:
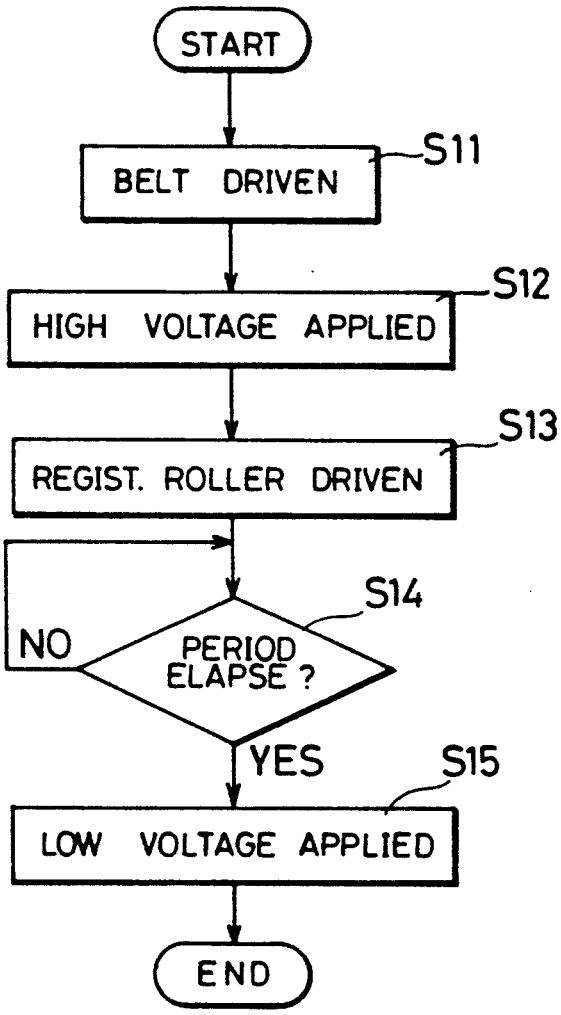
FIG. 6 is a flow chart showing operations of the second transfer device.

Next, there will be described operations of the second transfer device 11 with reference to a flow chart shown in FIG. 6.

When feeding of the copy sheet is started upon start of the copying operation, the transfer belt 12 is driven in Step S11. The high ac voltage from the first outlet tap 6*a* of the power supply unit 6 is converted into a high dc voltage by the converter 9 and applied to the brush member 3 in Step S12, and thereby the transfer belt 12 is charged with the high dc voltage by way of the brush member 3. In Step S13, in order to place the copy sheet on the charged region of the belt 12, the registration roller pair 42 are driven in such a manner that a leading edge of the charged region comes in line with a leading edge of the copy sheet. Thereby, the copy sheet is electrostatically attracted to the transfer belt 12 and transported to the photosensitive drum 30. At a position where the belt 12 is in pressing contact with the drum 30, the toner image formed on the drum 30 is transferred to the copy sheet due to the potential difference between the belt 12 and drum 30.

After the image transfer operation, the copy sheet is transported with attracted to the transfer belt 12. The charges of the belt 12 is released by the grounded intermediate roller 15*a* and drive roller 13. Accordingly, the copy sheet is separated from the belt 12 at a position where the drive roller 13 is disposed and further transported to the fixing device 44.

Subsequently, it is discriminated whether the charging period has elapsed following start of application of the high dc voltage to the brush member 3 in Step S14. This routine waits in standby in Step S14 while the time is measuring the charging period (NO in Step S14). Upon lapse of the charging period (YES in Step S14), the low ac voltage from the second outlet tap 6*b* of the power supply unit 6 is converted into the low dc voltage by the converter 9 and applied to the brush member 3 in Step S15. The toner residual on the transfer belt 12 is attracted to the brush member 3 due to the potential difference between the brush member 3 and belt 12, and thereby the belt 12 is cleaned.

In this way, since the transfer belt 12 is charged by way of the brush member 3, there can be obviated the need for a power source and a transformer exclusively for use in charging the belt 12. After the transfer belt 12 is charged with the high dc voltage by the distance corresponding to the length of the copy sheet, the low dc voltage is applied to the brush member 3 to clean the toner residual on the belt 12.

Figure 7:
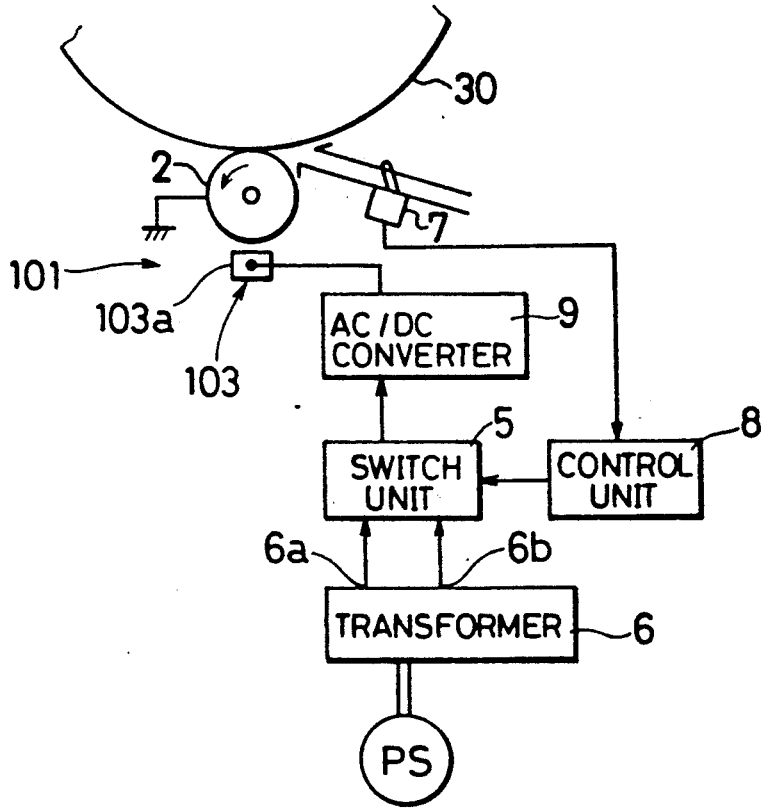
FIG. 7 is a schematic diagram showing a construction of a third transfer device in accordance with the invention.

FIG. 7 is a schematic diagram showing a construction of a third transfer device 101 in accordance with the invention. It will be appreciated that like numerals designate like parts in FIGS. 1 and 7.

In place of the brush member 3 and cleaning blade 4 of the first transfer device 1, the third transfer device 101 is provided with a cleaning charger 103.

The cleaning charger 103 is made of a conductive wire or like material and disposed in parallel to a transfer roller 2 with spaced away from the roller 2 by a specified distance. A dc voltage from an ac-to-dc converter 9 is applied to the cleaning charger 103. The cleaning charger 103 is accommodated in a cover 103*a* made of insulating material so as not to be stained by the toner attracted from the transfer roller 2. Upon application of a high dc voltage from the converter 9 to the cleaning charger 103, the transfer roller 2 is charged with the high dc voltage by way of the cleaning charger 103. When a copy sheet is transported to a nip between a photosensitive drum 30 and charged transfer roller 2, a toner image formed on the drum 30 is transferred to the copy sheet. On the other hand, upon application of a low dc voltage from the converter 9 to the cleaning charger 103, the toner residual on the transfer roller 2 is attracted to the cleaning charger 103 due to the potential difference between the cleaning charger 103 and roller 2, and thereby the roller 2 is cleaned. The roller 2 is grounded in a position downstream of the contact portion thereof with the drum 30 and upstream of the cleaning charger 103 so as to release the charges thereof. As spaced away from the transfer roller 2, the cleaning charger 103 is not to damage or spoil the roller 2.

The third transfer device 101 operates quite similarly to the first transfer device 1, and accordingly description on operations of the third device 101 is left out.

Figure 8:
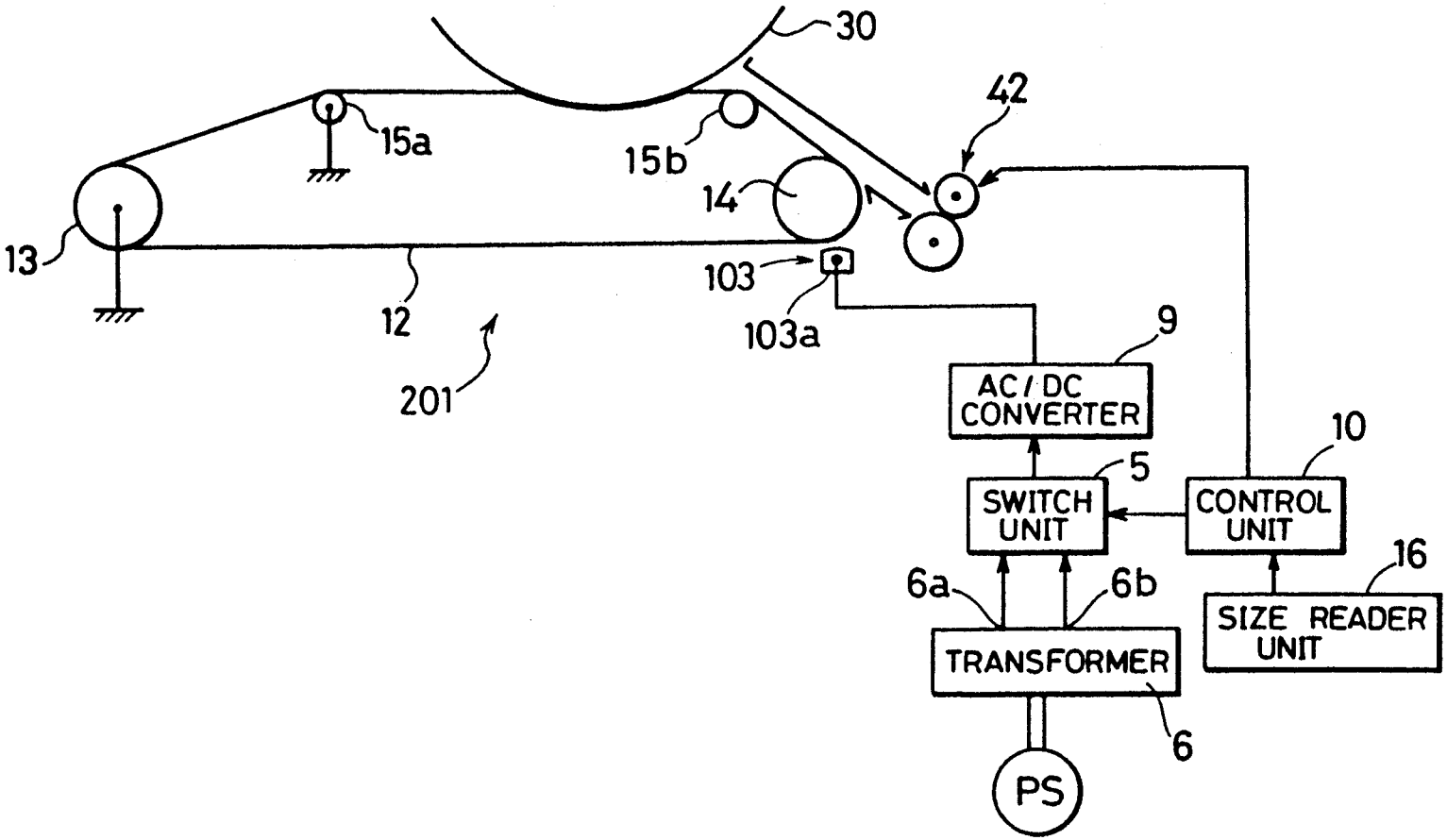
FIG. 8 is a schematic diagram showing a construction of a fourth transfer device in accordance with the invention.

FIG. 8 is a schematic diagram showing a construction of a fourth transfer device 201 in accordance with the invention. It will be appreciated that like numerals denote like parts in FIGS. 4 and 8.

In place of the brush member 3 and cleaning blade 4 of the second transfer device 11, the fourth transfer device 201 is provided with the aforementioned cleaning charger 103.

The fourth transfer device 201 operates quite similarly to the second transfer device 11, and accordingly description on operations of the fourth device 201 is left out.

It will be appreciated that the potential of the transfer roller 2 and transfer belt 12 is constantly smaller than that of the brush member 3 in the first and second transfer devices. Accordingly, the toner depositing on the roller 2 and belt 12 is attracted to the brush member 3 even during the image transfer operation, thereby cleaning the roller 2 and belt 12.

In the first and second transfer devices, it is preferable that the voltage used to clean the transfer roller 2 and transfer belt 12 be lower than the voltage used to transfer the toner image to the copy sheet in light of a life of the photosensitive drum 30. However, even if the former voltage is equal to or greater than the latter voltage, the brush member 3 is capable of attracting the toner residual on the roller 2 and belt 12 to clean the same. In other words, in the first transfer device, the transfer roller 2 can be cleaned when the high voltage is applied to the brush member 3 even after the image transfer operation. Likewise, in the second transfer device, the transfer belt 12 can be cleaned when the high voltage is applied to the brush member 3 even after the image transfer operation.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A transfer device for use in an image forming apparatus provided with image bearing means on which a toner image is formed, the transfer device comprising:

transfer means which is charged to transfer the toner image formed on the image bearing means to a copy sheet;

cleaner means for cleaning toner depositing on the transfer means;

power supply means for applying a voltage to the cleaner means to charge the transfer means;

the cleaner means being constructed so as to produce a potential difference between the cleaner means and transfer means to attract the toner depositing on the transfer means;

the cleaner means being supplied with a second voltage, which is used to clean the transfer means and which is lower than a first voltage required to charge the transfer means to have a potential at which the toner image is transferable to the copy sheet, while an image transfer operation is not carried out;

said power supply means including:

(i) an alternate current power source for outputting an alternate voltage;

(ii) transformer means having a first transformer unit for transforming the alternate voltage from the alternate current power source into a first alternate voltage and a second transformer unit for transforming the alternate voltage into a second alternate voltage, said transformer means having a first outlet tap and a second outlet tap;

(iii) switch means for switchingly outputting the first voltage from the first outlet tap and the second voltage from the second outlet tap;

(iv) conversion means for converting the first and second voltages from the switch means into respective direct voltages and applying the same to the cleaner means;

(v) detector means for detecting an image transfer period during which the toner image on the image bearing means is transferred to the copy sheet; and (vi) switch control means for causing the switch means to output the first alternative voltage at least during the image transfer period.

2. A transfer device as defined in claim 1 wherein the cleaner means includes a brush member made of conductive material in contact with the transfer means.

3. A transfer device as defined in claim 1 wherein the cleaner means is spaced from the transfer means by a specified distance.

4. A transfer device as defined in claim 1 wherein the transfer means includes a copy sheet introduction portion through which the copy sheet is introduced to the image bearing means, and the detector means includes sensor means disposed in proximity to the copy sheet introduction portion for detecting a leading edge and a trailing edge of the copy sheet and determines a period lasts until the trailing edge of the copy sheet is detected by the sensor means following detection of the leading edge thereof by the sensor means as an image transfer period.

5. A transfer device as defined in claim 1 wherein the transfer means includes a copy sheet introduction portion through which the copy sheet is introduced to the image bearing means, the detector means includes a sensor means disposed in proximity to the copy sheet introduction portion for detecting a leading edge of the copy sheet and calculation means for calculating the image transfer period based on the length of the copy sheet and detects based on a detected timing of the leading edge of the copy sheet and the calculated image transfer period whether the image transfer operation is currently carried out.

6. A transfer device as defined in claim 1 wherein the transfer means includes a transfer roller.

7. A transfer device as defined in claim 1 wherein the transfer means includes a transfer belt.

8. A transfer device for use in an image forming apparatus provided with image bearing means on which a toner image is formed, the transfer device comprising:

transfer means which is charged to transfer the toner image formed on the image bearing means to a copy sheet;

cleaner means for cleaning toner depositing on the transfer means;

power supply means for applying a voltage to the cleaner means to charge the transfer means;

the cleaner means being constructed so as to produce a potential difference between the cleaner means and transfer means to attract the toner depositing on the transfer means;

said power supply means including:

(i) an alternate current power source for outputting an alternate voltage;

(ii) transformer means having a first transformer unit for transforming the alternate voltage from the alternate current power source into a first alternate voltage and a second transformer unit for transforming the alternate voltage into a second alternate voltage, said transformer means having a first outlet tap and a second outlet tap;

(iii) switch means for switchingly outputting the first voltage from the first outlet tap and the second voltage from the second outlet tap;

(iv) conversion means for converting the first and second voltages from the switch means into respective direct voltages and applying the same to the cleaner means;

(v) detector means for detecting an image transfer period during which the toner image on the image bearing means is transferred to the copy sheet; and (vi) switch control means for causing the switch means to output the first alternative voltage at least during the image transfer period.

* * * * *